US006038829A

United States Patent [19]

Franks

[11] Patent Number: 6,038,829

[45] Date of Patent: Mar. 21, 2000

[54] ADAPTABLE SAFETY RAIL SYSTEM FOR FLAT ROOFS AND PARAPETS

[76] Inventor: Bert Franks, 3296 14th Avenue, Castlegar, B.C., Canada, V1N 4J2

[21] Appl. No.: 08/871,770

[22] Filed: Jun. 9, 1997

[51] Int. Cl.[7] ..... E04H 17/20; B21F 27/00

[52] U.S. Cl. ..... 52/645; 52/DIG. 12; 182/113; 248/237; 256/59; 256/65; 256/DIG. 6; 403/4

[58] Field of Search ..... 52/DIG. 12, 633, 52/645, 646; 182/113, 150; 248/237; 256/59, 65, 68, 69, DIG. 6; 403/3, 4

[56] References Cited

U.S. PATENT DOCUMENTS

| | | | |
|---|---|---|---|
| 3,867,997 | 2/1975 | Hyslop, Jr. | 182/113 |
| 4,037,824 | 7/1977 | Whitmer | 182/113 X |
| 5,029,670 | 7/1991 | Whitmer | 182/113 |
| 5,314,167 | 5/1994 | Holloman | 182/113 X |
| 5,379,859 | 1/1995 | Pigman | 182/45 |
| 5,431,372 | 7/1995 | Kostelecky | 256/59 X |
| 5,441,125 | 8/1995 | Cook | 52/DIG. 12 X |
| 5,513,826 | 5/1996 | Lebaron | 248/237 |
| 5,524,727 | 6/1996 | Yennie, Jr. | 182/150 X |

*Primary Examiner*—Carl D. Friedman
*Assistant Examiner*—Timothy B. Kang
*Attorney, Agent, or Firm*—Paul D. Gornall

[57] ABSTRACT

This invention relates to apparatus used in supporting safety rails and discloses a system in which a safety rail post support and security device is used in pairs or greater multiples to hold pieces of a safety rail at the edge of an elevated surface and is speedily attached to or detached from the three commonly found roof edge structures, that is, roofs that are flat right up to the edge, roofs that have a very low ledge or flashing around the perimeter, and roofs that have a parapet along the edge. Previous systems rely on cantilever weights positioned well in from the edge of the roof, interfering with the work to be done there. The post support and security device has a junction piece comprising four intersecting extruded stabilizer bars perpendicular to each other in one plane and a fifth bar protruding from that plane at ninety degrees. An upright post fits into one of the bars after the junction piece is bolted to a roof or to a wall abutting the edge of a roof, or is clamped to a parapet. The upright post has two brackets, each adapted to hold one or two 10 foot 2 by 4 inch lumber rails. The adaptable safety rail system of the present invention for flat roofs and parapets exceeds typical safety barrier standards for workers on such roofs.

20 Claims, 8 Drawing Sheets

ADAPTABLE SAFETY RAIL SYSTEM FOR FLAT ROOFS AND PARAPETS

FIELD OF THE INVENTION

This invention relates to apparatus used in supporting and securing safety rails. In particular, the invention discloses an adaptable safety rail system for flat roofs and parapets in which a safety rail post support and security device is used in pairs or greater multiples to hold pieces of lumber in the required position to form a safety barrier at the edge of a roof, parapet, bridge, or other elevated surface.

DESCRIPTION OF THE PRIOR TECHNOLOGY

There exist a variety of safety barrier systems for roofers and other workers or persons having a need to be near a roof edge or other drop-off. Many such systems rely on cantilever weights that are positioned well in from the edge of the roof and that interfere with the work to be done on the roof. Other such systems rely on ladders, scaffolds, or other extensive support structures.

None of the prior systems are as suitable and adaptable as the safety rail post support and security system of the present invention, which is readily attachable to and detachable from the three commonly found roof edge structures, that is, roofs that are flat right up to the edge, roofs that have a very low ledge or flashing around the perimeter, and roofs that have a parapet around the edge. The presently disclosed safety rail post support and security system meets a long-felt need in the roofing industry, and has applications for bridge-work or any situation where a safety barrier needs to be erected None of the prior technology discloses a system having the arrangement of features of the present invention.

SUMMARY AND OBJECTS OF THE PRESENT INVENTION

The safety rail post support and security device has a junction piece comprising four intersecting extruded bars perpendicular to each other in one plane and another bar protruding from that plane also at ninety degrees. An upright post fits into one of the bars, whichever is upright after attachment of the junction piece to a roof, to a wall abutting a roof edge, or to a parapet along a roof edge. The junction piece is bolted to a roof or to a wall abutting the edge of a roof, or is clamped to a parapet with clamping means that attach with bolts and cotter pins through holes in the clamping means and in others of the perpendicularly joined bars. The upright post is held in place on the upright bar with a bolt and cotter pin through aligned holes in the upright post and the upright bar. The upright post has two brackets affixed thereto, each adapted to hold one or two 10 foot 2 by 4 inch lumber rails. In the case of the post being an end post for the safety rail system, each bracket would hold one such 2 by 4 inch lumber rail. In the case of an inner post along the safety rail system, two such lumber rails would overlap within each such bracket.

Assembly and attachment of the device in the required configuration is fast compared to pre-existing roof safety rail systems. A team of only two workers can readily put up 200 feet of safety rail for a roof in an hour, using 10 foot 2 by 4 inch lumber rails overlapping a foot and a half as illustrated herein.

The adaptable safety rail system of the present invention for flat roofs and parapets exceeds safety barrier standards for workers on such roofs. Safety authorities in many jurisdictions have stipulated that workers require a safety guardrail or similar means of fall restraint when working on a structure from which a worker could fall 10 feet or more. Where a worker could fall 25 feet or more, safety codes in force can require written fall protection plans incorporating such guardrails and whatever other means can reasonably be used to prevent a worker from falling in the situation at hand.

An example of a regulatory authority requirement for such guardrails for safety purposes is that the guardrail vertical supports be less than 8 feet apart, and that the guardrail must be able to withstand a force of 200 pounds against it in any direction. In the case of a temporary anchor station for a fall restraint lifeline, fall safety regulations can specify that the anchor must be able to withstand at least 800 pounds of pressure in any direction in which a load may be applied.

When the bars of the junction piece and the upright post of the present system are made of 0.125 inch thick extruded tube steel having a sectional width of approximately 1 inch, and the other components of comparable size and material, excepting the rails, for which 10 foot long 2 inch by 4 inch lumber can be used, the present system exceeds the 200 pound load requirement for a guardrail. In the case of a roof or wall installation of the system, using three and one half inch lag bolts, going through 1 inch of the junction piece bars and two and one half inches into the sound wood of a roof, the junction piece and upright post can withstand 800 pounds of force at the top of one of the rail support posts of the system disclosed herein. A single such post can be used as a centre anchor post to which can be tied a safety rope for roofing the perimeter of the roof after the safety rail system is removed, preferably with the longest of the perpendicular bars in one plane of the junction piece pointing in the direction of the worker, as the longest bar has the greatest leverage effect to increase the holding power of the top of the upright post in the direction of the potential load on the top of the upright post.

When the support posts are lined up along a roof edge and linked with good quality, ten foot long 2×4 inch lumber overlapping 1 and " feet at a plurality of the interior junction pieces in the manner shown, there is a reinforcing effect, giving the safety rail system a load limit far in excess of the 200 pound standard at any given point on the safety rail and even in excess of the 800 pound standard for any outward pressure at any given point along the safety rail. In the case of the safety post device being installed as shown herein on a parapet, tests of the system have shown that a typical concrete parapet would break before the safety post could be toppled outward, again far exceeding the safety standards noted above.

A preferred embodiment of the invention is an adaptable safety rail system for flat roofs and parapets comprising the following features:

a) a post support and security junction piece having a pair of opposing stabilizer bars in one plane, a third stabilizer bar joined substantially perpendicular to the opposing stabilizer bars in the same plane, an extension bar joined to the three stabilizer bars substantially perpendicular to the opposing stabilizer bars in the same plane and aligned with the third stabilizer bar, and a protruding bar extending substantially perpendicular from the said plane, the opposing stabilizer bars having holes therein adapted to receive a shaft of a lag bolt whereby the post support and security junction piece can be bolted securely to a roof, wall or other elevated surface;

b) junction piece clamping means comprising a first clamp means mountable on the extension bar and a second, cooperating clamp means mountable on the third stabilizer bar, whereby the junction piece can be clamped onto a parapet;

c) an upright post adapted to fit into one of the bars after the junction piece is bolted to a roof or to a wall abutting the edge of a roof, or is clamped to a parapet by the clamping means, the upright post having at least one bracket, adapted to hold one or two rail members;

d) post securing means for retaining the upright post in one of the bars;

e) rail securing means for retaining a rail member in the bracket.

Appropriate dimensions to meet the objects of safety and versatility would be for the opposing stabilizer bars, the third stabilizer bar, and the protruding bar to each be approximately six inches in length, and for the extension bar to be approximately fifteen inches in length.

It is best is there is a second, lower bracket on each post to secure a second railing below the top safety railing supported by the upright post. The rail securing means can be a screw clamp threadably engaged with each bracket. The upright post should be approximately forty-two inches in length, to meet typical safety requirements for the height of the top rail member secured in the top bracket.

The post securing means is a post retaining bolt through a first hole in the protruding bar aligned with a first hole in the upright post, and the post retaining bolt is retained through the upright post and the protruding bar by means of a cotter pin on an end of the post retaining bolt.

The junction piece clamping means comprises a first clamp sleeve slidable on the extension bar until affixed in a selected position on the extension bar and a second clamp sleeve slidable on the third stabilizer bar until affixed in a selected position on the third stabilizer bar, whereby the junction piece can be clamped onto different parapets of varying widths, in which one of the clamp sleeves has a first clamp arm extending perpendicular from that one of the clamp sleeves at a first clamp arm end, the first clamp arm having an inner clamp stop pad adjacent to an opposite end of the first clamp arm, and another of the clamp sleeves has a second clamp arm extending perpendicular from that other of the clamp sleeves at a second clamp arm end, the second clamp arm having a threaded clamp screw with a clamp handle at an outer end of the threaded clamp screw and a clamp screw pad at an inner end of the threaded clamp screw, the threaded clamp screw being engaged with a complementary threaded bore through the second clamp arm adjacent to an opposite end of the second clamp arm, the clamp screw pad thereby facing the clamp stop pad at an distance therefrom that is adjustable by screwing the threaded clamp screw in the threaded bore through the second clamp arm.

An alternate means of attaching the upright post to the junction piece is to have a joining sleeve sized to slide over the upright post and the third stabilizer bar, the joining sleeve being held in position by means of a first bolt through a first hole in the joining sleeve aligned with a first hole in the upright post, and a second bolt through a second hole in the joining sleeve aligned with a second hole in the third stabilizer bar, and in which the first and second bolt are retained respectively through the first hole in the joining sleeve and the first hole in the joining sleeve, and through the second hole in the third stabilizer bar and the second hole in the joining sleeve, by means of a cotter pin on each of a first and second bolt end on the first and second bolts respectively.

If mild steel of approximately 0.125 inch thickness formed into tubes approximately 1 inch wide is used for the stabilizer bars, the extension bar and the upright post, the system will have the required strength. Using mild tube steel is better than using, for example, stainless steel, because the mild steel is more resilient, and is more resistant to cracking or breaking under sudden shocks that might be encountered on a construction site. The clamp sleeves, the joining sleeve and the protruding bar should be of like strong material sized to slidably engaged the indicated parts. The clamp sleeves should be at least 4 inches long to provide the necessary strength when in position on the junction piece. The clamp arms should be even longer than the clamp sleeves to provide a grip by the clamping means well down on a parapet when the junction piece is used on a parapet.

The above-described system can be joined perpendicularly to another such system at the corner of a roof, and perpendicular ends of the rail members of the systems should be joined by at least one corner bracket adapted to fit over the said ends of the rail members, the corner bracket having rail member end retaining means comprising a screw clamp threadably engaged with each of two perpendicular sections forming the corner bracket. The system's strength is enhanced by linking more bolted-down junction pieces, by overlapping rail members retained by the rail securing means; and is enhanced even more greatly by a secure attachment to a like system at a ninety-degree corner, for example by one corner bracket for the top rail and one for the lower rail at each such corner, the corner bracket being adapted to fit over the said ends of the rail members, the corner bracket having rail member end retaining means comprising a screw clamp threadably engaged with each of two perpendicular sections forming the corner bracket.

Lag bolts at least ⅜ inch thick and 3" inches long should be used to bolt the junction piece to the elevated surface. This will provide the requisite loading capacity for the safety rail only if the lag bolts are screwed into wood or like material on the elevated surface that is sound and strong itself.

The rail members should be secured in the brackets such that the rail members are parallel to an edge of an elevated surface adjacent to which the post support and security junction piece of the respective bracket is attached and the extension piece of the respective junction piece is positioned perpendicular to the respective edge of the elevated surface, the extension bar of each junction piece being longer than the opposing stabilizer bar of the respective junction piece in order to provide a greater leverage effect to stabilize the system during the application of a lateral force to the rail member parallel to the length of the extension bar.

With these features the system can be readily attached to and detached from a roof that is flat right up to an edge of the roof, to a wall abutting a roof, or to a parapet along an edge of the roof, and will provide a safety rail structure that exceeds typical safety requirements for workers.

DETAILED DESCRIPTION

Figure 1:
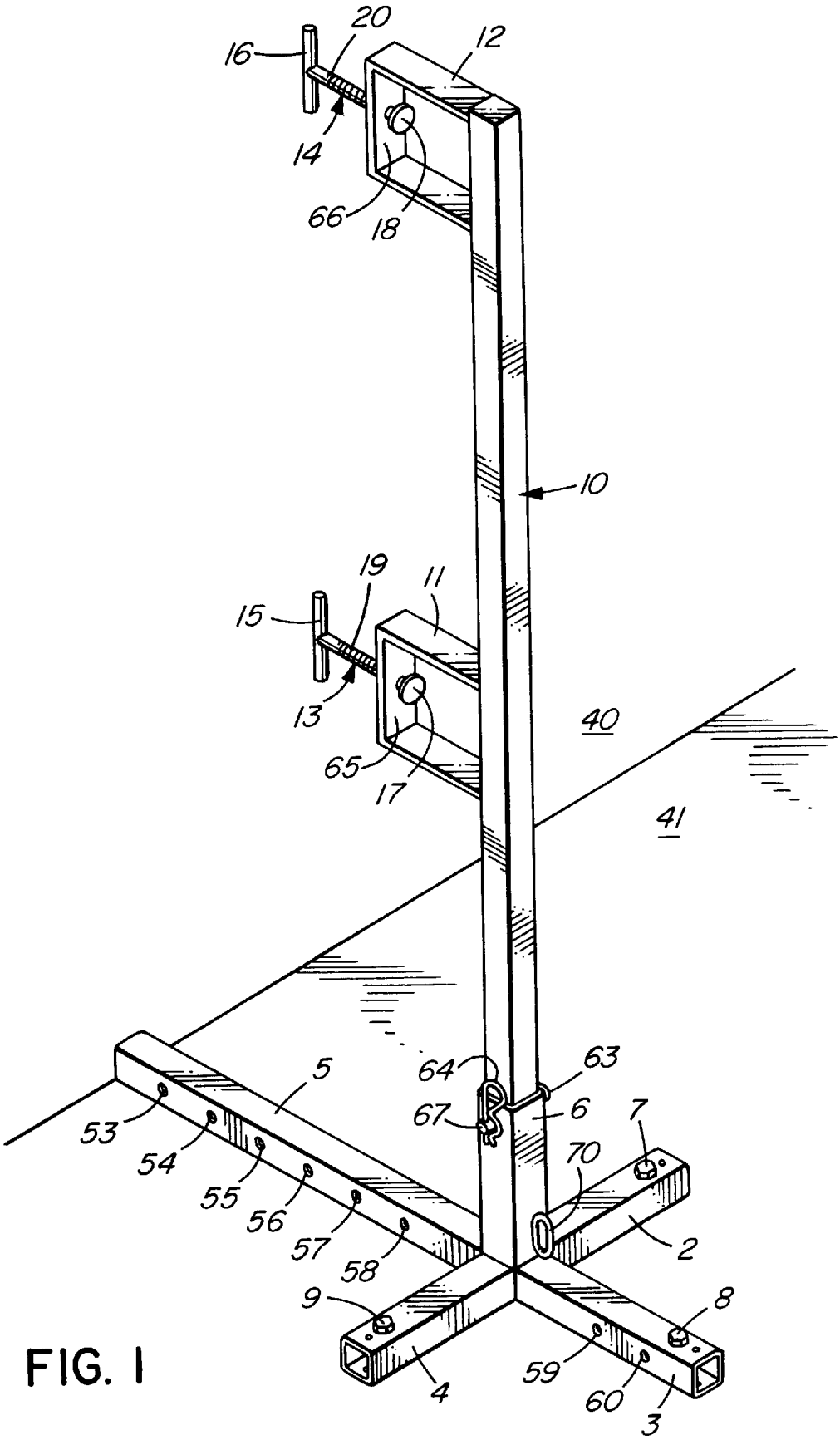
FIG. 1 is an isometric perspective of the junction piece and upright post of the adaptable safety rail post support and security system, bolted onto a flat roof near its edge.

Referring to FIG. 1, the junction piece comprises opposing stabilizer bars 2 and 4 intersecting perpendicularly with and in the same plane as the extension bar 5 and its opposing third stabilizer bar 3. Protruding upright at ninety degrees to that plane is the upright protruding bar 6, into which the upright post 10 has been inserted. It is retained within the upright protruding bar 6 by bolt 63 being inserted through aligned holes in the upright protruding bar 6 and the upright post 10. The bolt 64 is itself retained in position with a cotter pin 64 mounted to the bolt end 67. A wire or chain could be used to join each of the cotter pin 64 and the bolt 63 to the metal loop 70 welded to the junction piece in order to keep the cotter pin 64 and bolt 63 at hand during assembly of the safety rail post support and security system. The junction piece is bolted by bolts 7, 8, and 9 to the roof surface 41 adjacent to the roof edge 40. Brackets 11 and 12 are welded or otherwise affixed at the desired height to the upright post.

For typical roofing work, it is appropriate to have an upright post 42 inches long, or whatever length is recommended or required for worker safety in any given situation, with bracket 12 adjacent to the top of the post, and with bracket 11 approximately half-way up the upright post 10. In each of the middle members 65 and 66 respectively of the brackets 11 and 12 is mounted a clamping screw, 13 and 14 respectively, each having a threaded portion (19 and 20 respectively) fitting within a complementary threaded portion within each of the middle members 65 and 66, by which the user can turn handles 15 and 16 in order to press clamping pads 17 and 18 against lumber rails (shown in FIG. 4) inserted into the brackets 11 and 12. The opposing stabilizer bars 2 and 4 and the third stabilizer bar 5 should be approximately six inches long. This gives ample lateral stabilization by the bars when they are bolted to the roof. The upright protruding bar 6 should also be approximately six inches long, to give sufficiently strong overlap for the upright post 10 that is inserted into the upright protruding bar 6. The extension bar 5 should be approximately inches long. Its extra length in combination with the stabilizer bars 2 and 4 and the third stabilizer bar 3 being bolted down gives a leverage effect to keep the safety rail post system from being pushed over.

Figure 2:
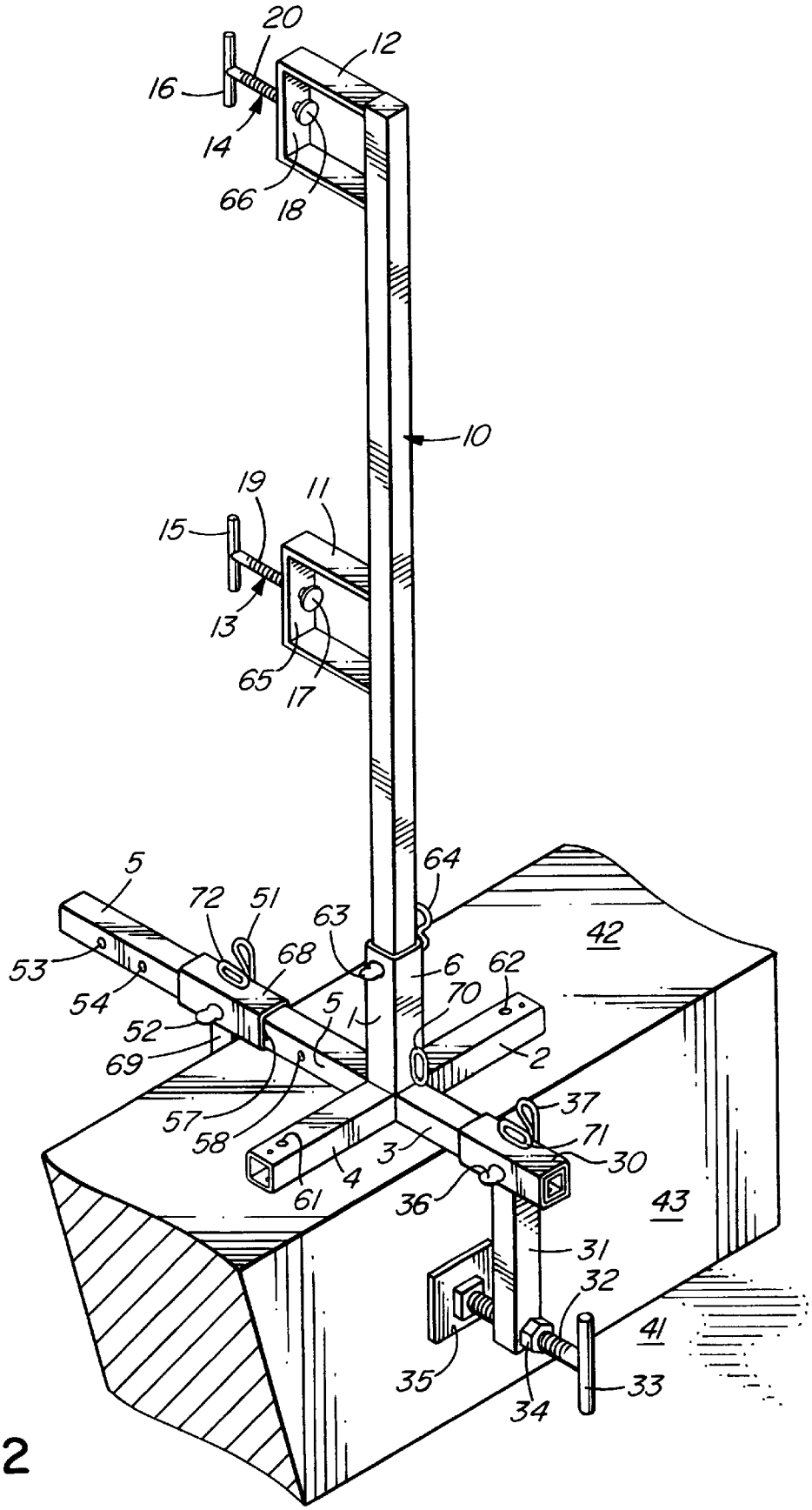
FIG. 2 is an isometric perspective of the junction piece and upright post of the adaptable safety rail post support and security system, clamped onto a parapet.
Figure 6:
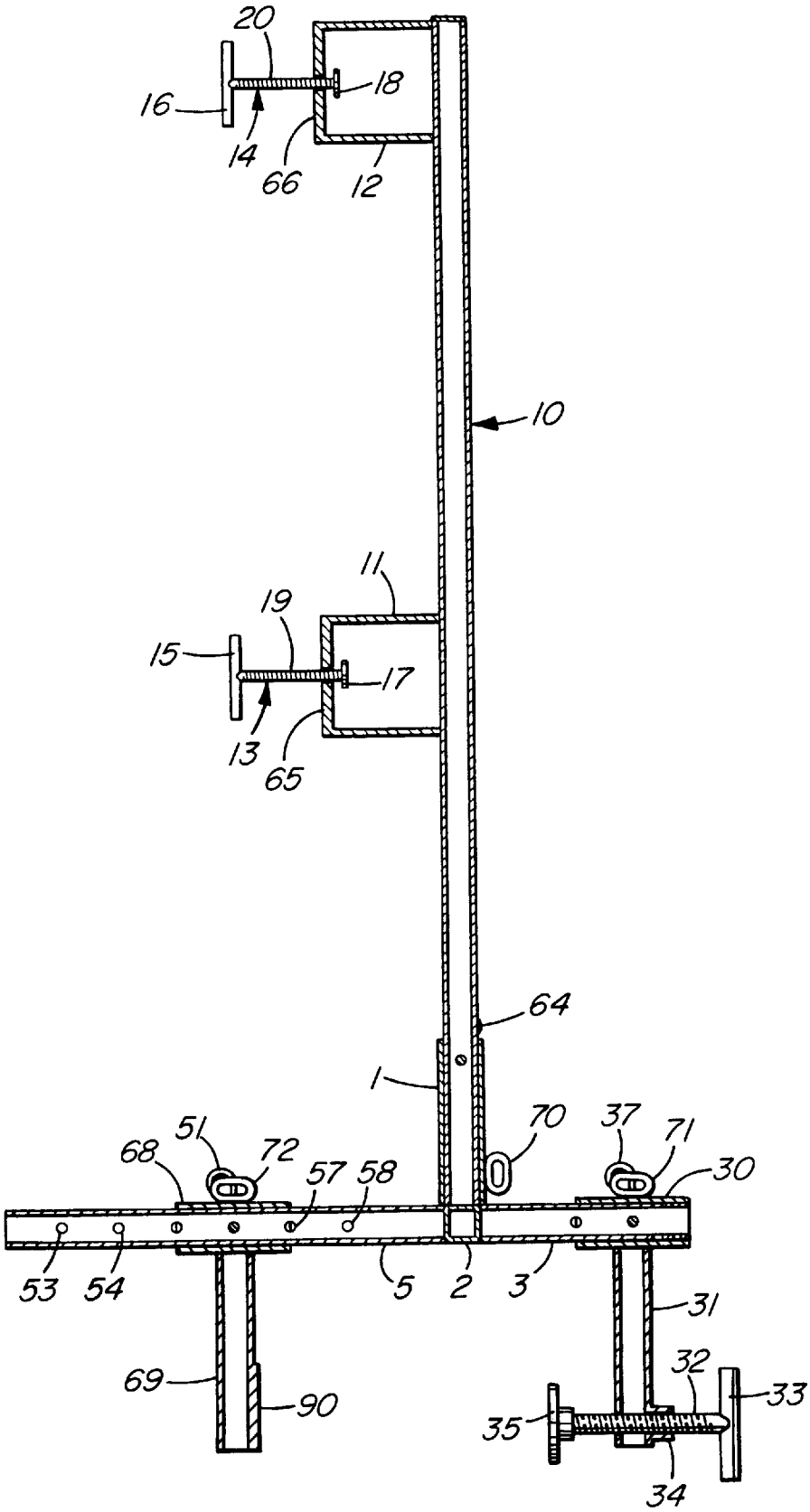
FIG. 6 is a side cross-sectional view of the junction piece and upright post of the adaptable safety rail post support and security system in the configuration shown in FIG. 2.
Figure 7:
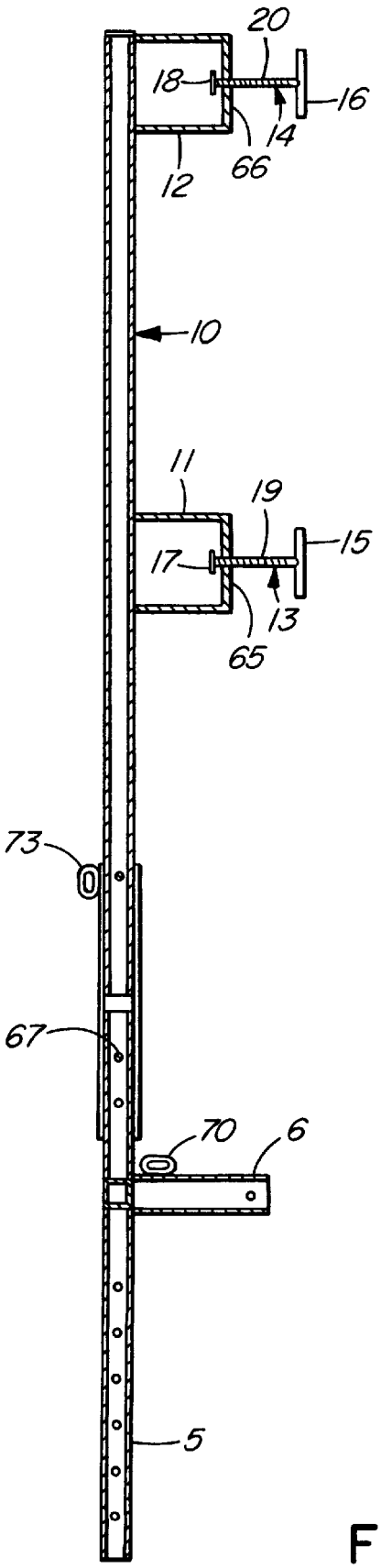
FIG. 7 is a side cross-sectional view of the junction piece and upright post of the adaptable safety rail post support and security system in the configuration shown in FIG. 3.
Figure 8:
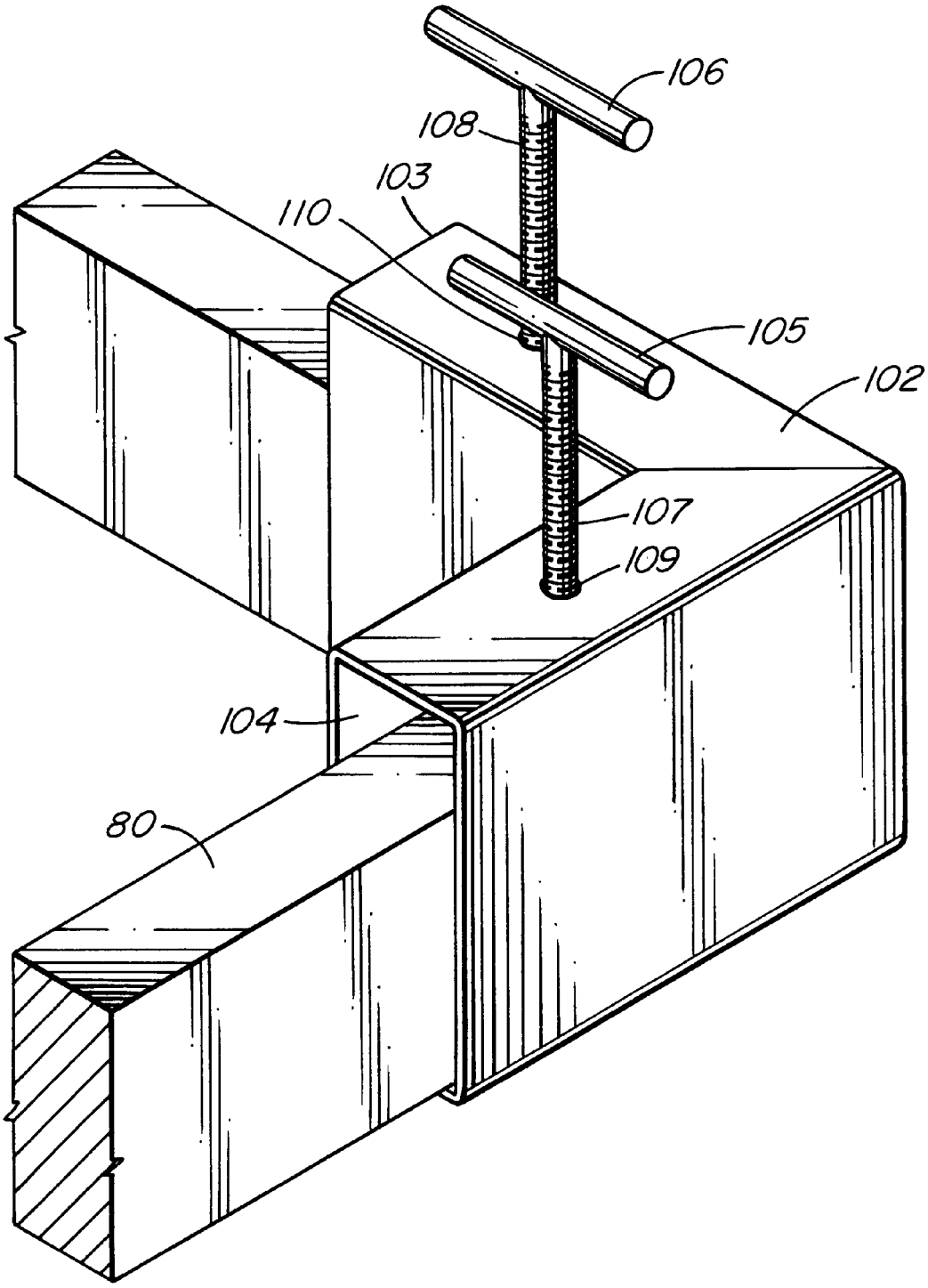
FIG. 8 is an enlarged perspective of a corner bracket with lumber end retaining means used to secure the perpendicular ends of the lumber rails of the configuration shown in FIG. 4.

The extension bar being 15 inches long also provides sufficient length to accommodate typical parapet widths when used in the configuration shown in FIG. 2. In FIG. 2 the junction piece rests on top of the parapet and is clamped to the parapet by means of clamp sleeve 30, which is mounted onto the third stabilizer bar 3 by bolt 36 through aligned holes in the clamp sleeve 30 and the third stabilizer bar 3. (The holes shown at 59 and 60 in FIG. 1 provide a couple of different positions for the clamp sleeve.) The bolt 36 is retained in position by means of cotter pin 37. To the clamp sleeve 30 is affixed a clamp arm 31, through a threaded aperture of which is mounted a complementary threaded clamping screw 32 enabling the user by turning the clamp handle 33 to press the clamp pad 35 against the vertical side 43 of the parapet 42 around the roof surface 41. A locking nut 34 can be used to secure the clamping means remains tightly up against the parapet's vertical side 43. The clamp sleeve 30, clamp arm 31, clamp screw 32, and clamp pad 35 form a clamping means in conjunction with the junction piece having also a clamp stop mechanism mounted to its extension bar 5 on the other side of the parapet 42. The clamp stop mechanism comprises a clamp stop sleeve 68 affixed to a clamp stop arm 69 having a clamp stop pad 90 (shown in FIG. 6). The clamp stop sleeve 68 is mounted to the extension bar 5 and held in place by bolt 52 through aligned holes in the clamp sleeve 30 and the third stabilizer bar 3. (The holes shown at 53, 54, 55, 56, 57, and 58 provide a variety of different positions for the clamp stop sleeve) The bolt 52 is retained in position by means of cotter pin 51. Metal loops 71 and 72 mounted to the respective clamp sleeves can have a wire or chain attached thereto for each bolt or cotter pin used in the clamping mechanism, in order to prevent their being lost. safety rail post support and security system is thus shown to be adaptable to the parapet situation commonly found around the perimeter of a roof. The height of the upright post 10 can be selected to be such that the total height of the upper railing above the roof surface 41 is approximately 42 inches, that is, the upright post 10 for this configuration could be selected to be lower than an upright post appropriate for the FIG. 1 configuration by a length approximately equal to the height of the parapet 42 above the roof surface 41.

Figure 3:
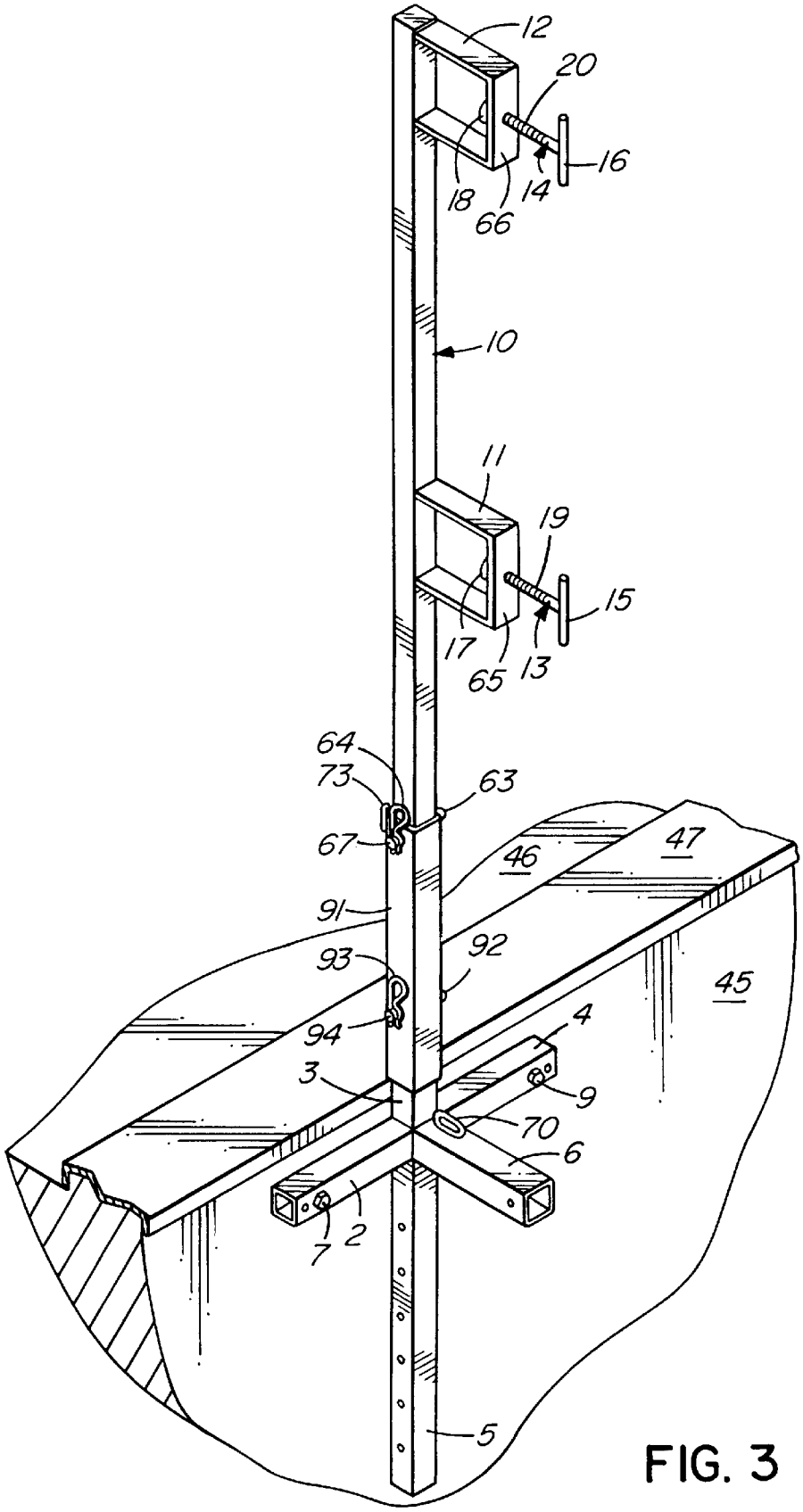
FIG. 3 is an isometric perspective of the junction piece and upright post of the adaptable safety rail post support and security system, bolted onto a wall abutting the edge of a roof.

Referring to FIG. 3, a flashing 47 around the roof surface 46 can prevent the use of the simple flat roof FIG. 1 configuration for the safety rail post support and security system. In this situation, the junction piece can be mounted to the wall 45 abutting the roof edge by means of lag bolts 7 and 9 through the stabilizer bars 2 and 4. The extension bar 5 still provides the leverage to keep the safety rail post support and security system up even as against forces greater than 200 pounds being applied to the top of the upright post 10 from the area above the roof surface 46. In this configuration, a sleeve 91 is shown as a joining mechanism into which fit both the third stabilizer bar 3 and the upright post 10, which each being retained within the sleeve 91 by means of bolt 63 through aligned holes in the sleeve 91 and the upright post 10, and by means of bolt 92 through the sleeve 91 and the third stabilizer bar 3, the bolts 63 and 92 being retained in position by means of cotter pins 64 and 93 mounted on the bolt ends 67 and 94 respectively. Metal loops 70 and 73 mounted to the protruding bar 6 and the sleeve 91 can be used to wire or chain the bolts and cotter pins required to keep them from getting lost during assembly and disassembly of the safety rail post support and security system.

Figure 4:
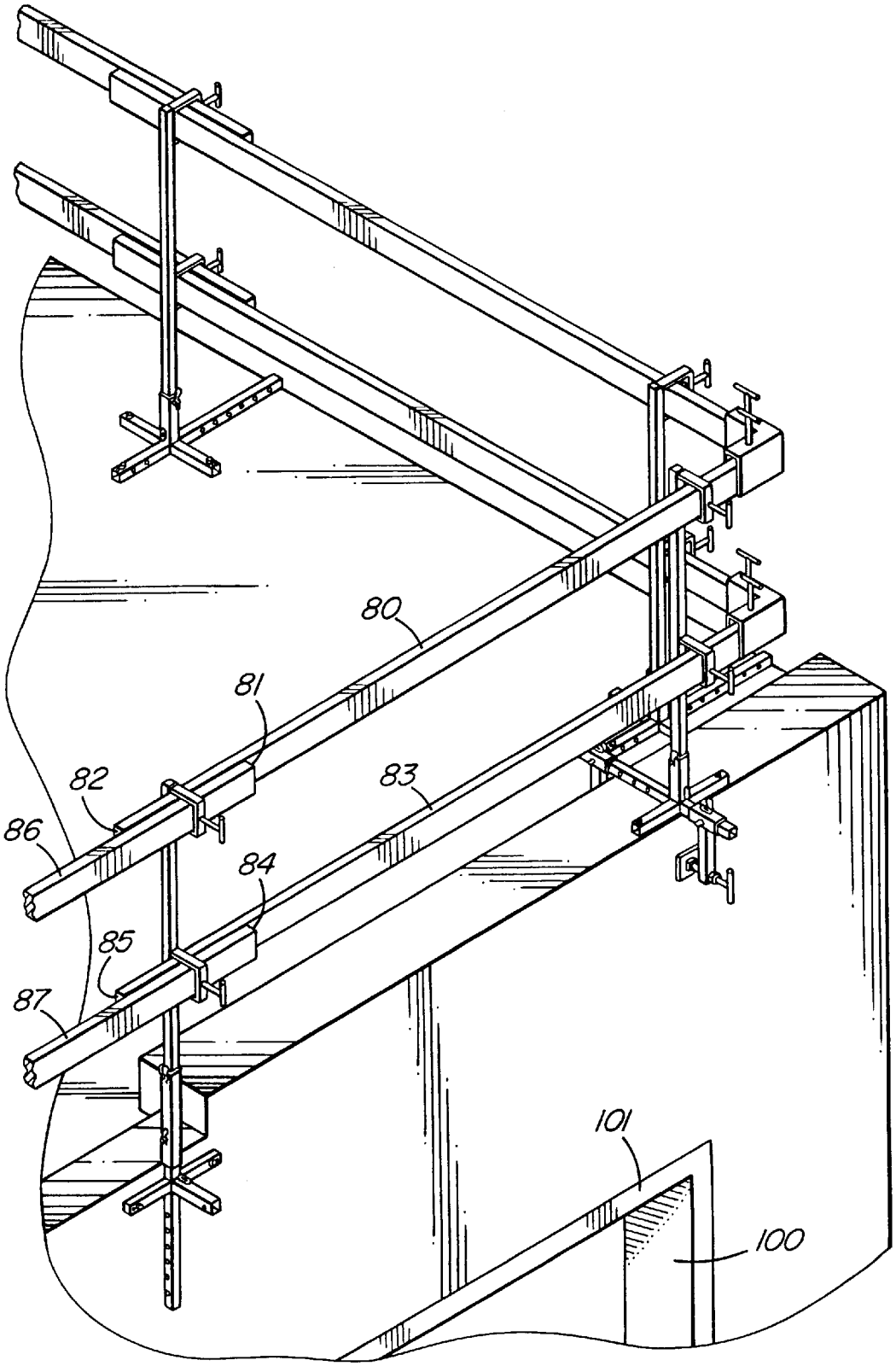
FIG. 4 is an isometric perspective showing three pairs of the junction piece and upright post of the adaptable safety rail post support and security system, being used in the three respective configurations of FIGS. 1, 2 and 3 to support and secure a safety railing on one roof having a variety of roof edge structures.

Referring to FIG. 4, all three configurations of the are shown in use simultaneously, illustrating the versatility and adaptability of the system. The 2×4 inch lumber rails 80, 81, 86 and 87, should be ten feet long, to provide a good balance between strength and assembly time. The lumber rails should overlap approximately one and one half feet, with the centre of the overlap being within the brackets affixed to the upright posts. Thus, the distance between the lumber rail ends 82 and 81 on lumber rails 86 and 80 respectively is approximately one and one half feet, and there is a like distance between the lumber rail ends 85 and 84 on lumber rails 87 and 83 respectively. Alternatively, the rails used in the system could be made of thicker wood, or of aluminum, plastic, or any other suitable material. The safety rail post support and security system as disclosed herein meets typical safety requirements for roofing work even without the rails being joined at the corner of a roof, but the corners of the safety rail system can optionally be nailed, screwed or joined with corner brackets for additional strength at the corners.

Figure 5:
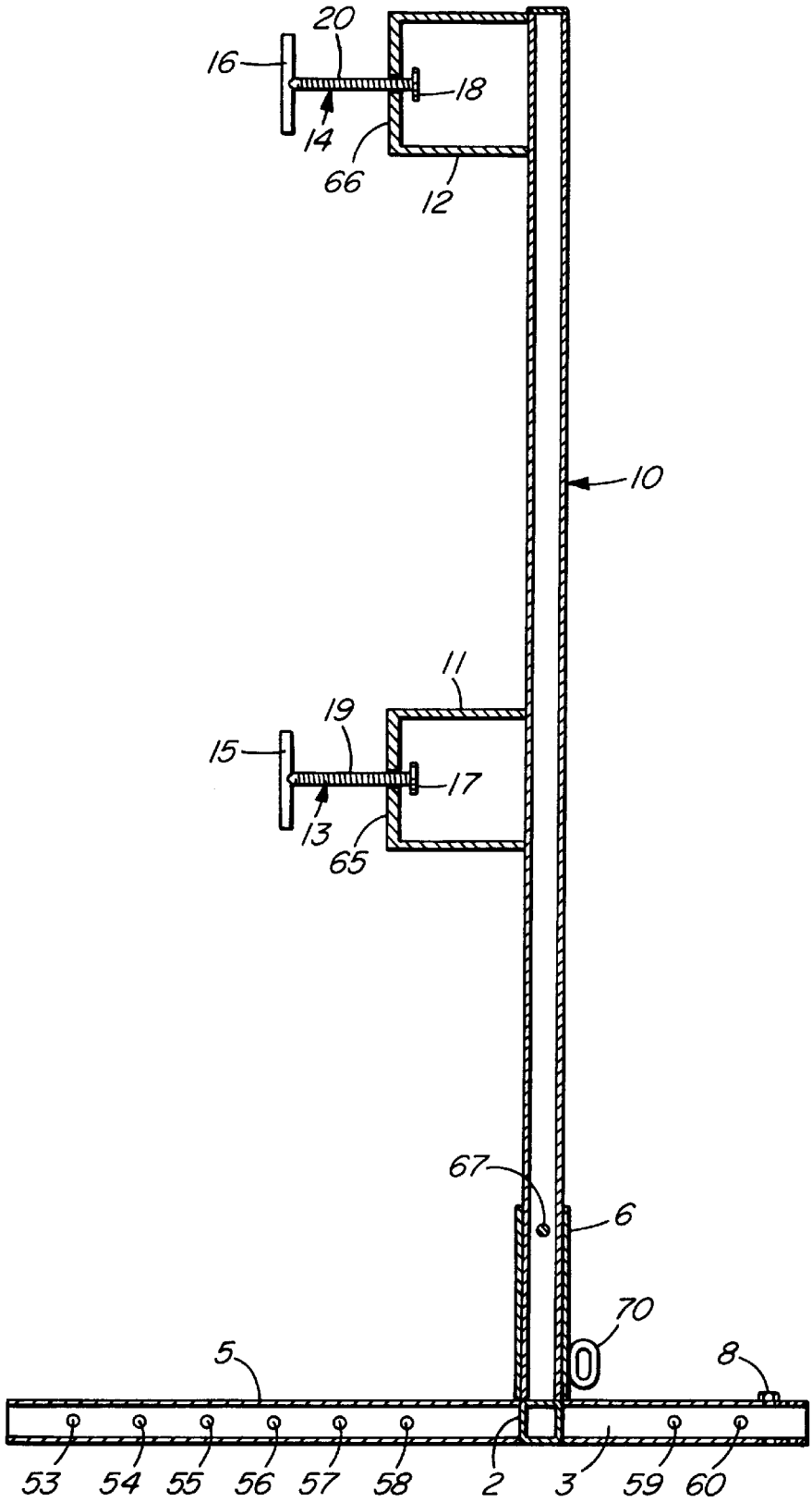
FIG. 5 is a side cross-sectional view of the junction piece and upright post of the adaptable safety rail post support and security system in the configuration shown in FIG. 1.

Referring to FIG. 5, the upright post 10 fits into the bars of the junction piece, but it is apparent that the system would work the other way around, with the upright bar 6 of the junction piece fitting within an protruding bar or pipe used for the upright post 10.

The within-described invention may be embodied in other specific forms and with additional options and accessories without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalence of the claims are therefore intended to be embraced therein.

I claim:

1. An adaptable safety rail system for flat roofs and parapets, comprising:

a) a post support and security junction piece having a pair of opposing stabilizer bars in one plane, a third stabilizer bar joined substantially perpendicular to the opposing stabilizer bars in the same plane, an extension bar joined to the three stabilizer bars substantially perpendicular to the opposing stabilizer bars in the same plane and aligned with the third stabilizer bar, and a protruding bar extending substantially perpendicular from the said plane, the opposing stabilizer bars having holes therein adapted to receive a shaft of a lag bolt whereby the post support and security junction piece can be bolted securely to a roof, wall or other elevated surface;

b) a first clamp means mountable on the extension bar and a second, cooperating clamp means mountable on the third stabilizer bar, whereby the junction piece can be clamped onto a parapet;

c) an upright post adapted to fit into one of the bars after the junction piece is bolted to a roof or to a wall abutting the edge of a roof, or is clamped to a parapet by the clamping means, the upright post having at least one bracket, adapted to hold one or two rail members;

d) post securing means for retaining the upright post in one of the bars;

e) rail securing means for retaining a rail member in the bracket;

whereby the system can be readily attached to and detached from a roof that is flat right up to an edge of the roof, to a wall abutting a roof, or to a parapet along an edge of the roof.

2. The system as defined in claim 1, in which a multiplicity of said post support and security junction pieces are linked by a multiplicity of overlapping rail members retained by the rail securing means.

3. The system as defined in claim 2, in which a rail member is positioned in the bracket such that the rail member is adapted to be placed parallel to a horizontal edge of an elevated surface onto which the post support and security junction piece is to be attached and the extension piece is adapted to be positioned perpendicular to the horizontal edge of the elevated surface, the extension bar being longer than the opposing stabilizer bars in order to provide a greater leverage effect to stabilize the system during the application of a lateral force to the rail member parallel to the length of the extension bar.

4. The system as defined in claim 3, in which:

a) the rail members are lengths of two inch by four inch lumber;

b) the system is adapted to be joined perpendicularly to another such system at the corner of a roof, by having at least one corner bracket adapted to fit over the said ends of the rail members, the corner bracket having rail member end retaining means, comprising a screw clamp threadably engaged with each of two perpendicular sections forming the corner bracket;

c) lag bolts at least ⅜ inch thick and 3½ inches long are used to bolt the junction piece to the elevated surface.

5. The system as defined in claim 2, in which the rail members are lengths of two inch by four inch lumber.

6. The system as defined in claim 2, in which the system is adapted to be joined perpendicularly to another such system at the corner of a roof, by having at least one corner bracket adapted to fit over the said ends of the rail members, the corner bracket having rail member end retaining means.

7. The system as defined in claim 6, in which the rail member end retaining means is a screw clamp threadably engaged with each of two perpendicular sections forming the corner bracket.

8. The system as defined in claim 1, in which the opposing stabilizer bars, the third stabilizer bar, and the protruding bar are each approximately six inches in length, and the extension bar is approximately fifteen inches in length.

9. The system as defined in claim 8, in which:

a) the extension bar is approximately fifteen inches in length and the upright post is approximately forty-two inches in length;

b) the clamping means comprises a first clamp sleeve slidable on the extension bar until affixed in a selected position on the extension bar and a second clamp sleeve slidable on the third stabilizer bar until affixed in a selected position on the third stabilizer bar, whereby the junction piece can be clamped onto different parapets of varying widths, in which one of the clamp sleeves has a first clamp arm extending perpendicular from that one of the clamp sleeves at a first clamp arm end, the first clamp arm having an inner clamp stop pad adjacent to an opposite end of the first clamp arm, and another of the clamp sleeves has a second clamp arm extending perpendicular from that other of the clamp sleeves at a second clamp arm end, the second clamp arm having a threaded clamp screw with a clamp handle at an outer end of the threaded clamp screw and a clamp screw pad at an inner end of the threaded clamp screw, the threaded clamp screw being engaged with a complementary threaded bore through the second clamp arm adjacent to an opposite end of the second clamp arm, the clamp screw pad thereby facing the clamp stop pad at an distance therefrom that is adjustable by screwing the threaded clamp screw in the threaded bore through the second clamp arm;

c) there is a joining sleeve sized to slide over the upright post and the third stabilizer bar, the joining sleeve being held in position by means of a first bolt through a first hole in the joining sleeve aligned with a first hole in the upright post, and a second bolt through a second hole in the joining sleeve aligned with a second hole in the third stabilizer bar, and in which the first and second bolt are retained respectively through the first hole in the joining sleeve and the first hole in the joining sleeve, and through the second hole in the third stabilizer bar and the second hole in the joining sleeve, by means of a cotter pin on each of a first and second bolt end on the first and second bolts respectively;

d) the post securing means is a post retaining bolt through a first hole in the protruding bar aligned with a first hole in the upright post, and the post retaining bolt is retained through the upright post and the protruding bar by means of a cotter pin on an end of the post retaining bolt;

e) there are two brackets on each upright post, a top bracket for a top rail member and a lower bracket for a lower rail member, and in which the the rail securing means is a screw clamp threadably engaged with each bracket;

f) mild steel of approximately 0.125 inch thickness formed into tubes approximately 1 inch wide is used for the stabilizer bars, the extension bar and the upright post.

10. The system as defined in claim 9, in which:

a) a multiplicity of said post support and security junction pieces are linked by overlapping rail members retained by the rail securing means;

b) rail members are secured in the brackets such that the rail members are parallel to an edge of an elevated surface adjacent to which the post support and security junction piece of the respective bracket is attached and the extension piece of the respective junction piece is positioned perpendicular to the respective edge of the elevated surface, the extension bar of each junction piece being longer than the opposing stabilizer bar of the respective junction piece in order to provide a greater leverage effect to stabilize the system during the application of a lateral force to the rail member parallel to the length of the extension bar;

c) the rail members are lengths of two inch by four inch lumber;

d) the system is joined perpendicularly to another such system at the corner of a roof, and perpendicular ends of the rail members of the systems are joined by at least one corner bracket adapted to fit over the said ends of the rail members, the corner bracket having rail member end retaining means comprising a screw clamp threadably engaged with each of two perpendicular sections forming the corner bracket;

e) lag bolts at least ⅜ inch thick and 3½ inches long are used to bolt the junction piece to the elevated surface.

11. The system as defined in claim 1, in which the upright post is approximately forty-two inches in length.

12. The system as defined in claim 1, in which the clamping means comprises a first clamp sleeve slidable on the extension bar until affixed in a selected position on the extension bar and a second clamp sleeve slidable on the third stabilizer bar until affixed in a selected position on the third stabilizer bar, whereby the junction piece can be clamped onto different parapets of varying widths.

13. The system as defined in claim 12, in which one of the clamp sleeves has a first clamp arm extending perpendicular from that one of the clamp sleeves at a first clamp arm end, the first clamp arm having an inner clamp stop pad adjacent to an opposite end of the first clamp arm, and another of the clamp sleeves has a second clamp arm extending perpendicular from that other of the clamp sleeves at a second clamp arm end, the second clamp arm having a threaded clamp screw with a clamp handle at an outer end of the threaded clamp screw and a clamp screw pad at an inner end of the threaded clamp screw, the threaded clamp screw being engaged with a complementary threaded bore through the second clamp arm adjacent to an opposite end of the second clamp arm, the clamp screw pad thereby facing the clamp stop pad at an distance therefrom that is adjustable by screwing the threaded clamp screw in the threaded bore through the second clamp arm.

14. The system as defined in claim 1, in which there is a joining sleeve sized to slide over the upright post and the third stabilizer bar, the joining sleeve being held in position by means of a first bolt through a first hole in the joining sleeve aligned with a first hole in the upright post, and a second bolt through a second hole in the joining sleeve aligned with a second hole in the third stabilizer bar.

15. The system as defined in claim 14, in which the first and second bolt are retained respectively through the first hole in the joining sleeve and the first hole in the joining sleeve, and through the second hole in the third stabilizer bar and the second hole in the joining sleeve, by means of a cotter pin on each of a first and second bolt end on the first and second bolts respectively.

16. The system as defined in claim 1, in which the post securing means is a post retaining bolt through a first hole in the protruding bar aligned with a first hole in the upright post.

17. The system as defined in claim 1, in which the post retaining bolt is retained through the upright post and the protruding bar by means of a cotter pin on an end of the post retaining bolt.

18. The system as defined in claim 1, in which the rail securing means is a screw clamp threadably engaged with the bracket.

19. The system as defined in claim 1, in which mild steel of approximately 0.125 inch thickness formed into tubes approximately 1 inch wide is used for the stabilizer bars, the extension bar and the upright post.

20. The system as defined in claim 1, in which lag bolts at least ⅜ inch thick and 3½ inches long are used to bolt the junction piece to the elevated surface.

* * * * *